US009576448B2

(12) United States Patent
Liu

(10) Patent No.: US 9,576,448 B2
(45) Date of Patent: Feb. 21, 2017

(54) HOME SECURITY SYSTEM USING WIRELESS COMMUNICATION

(75) Inventor: Yang Liu, Beijing (CN)

(73) Assignee: TELEFONAKTIEBOLAGET L M ERICSSON, Stockholm (SE)

( * ) Notice: Subject to any disclaimer, the term of this patent is extended or adjusted under 35 U.S.C. 154(b) by 191 days.

(21) Appl. No.: 14/381,449

(22) PCT Filed: Mar. 15, 2012

(86) PCT No.: PCT/CN2012/000321
§ 371 (c)(1),
(2), (4) Date: Aug. 27, 2014

(87) PCT Pub. No.: WO2013/134892
PCT Pub. Date: Sep. 19, 2013

(65) Prior Publication Data
US 2015/0130614 A1 May 14, 2015

(51) Int. Cl.
*G08B 13/00* (2006.01)
*G08B 13/24* (2006.01)
(Continued)

(52) U.S. Cl.
CPC ..... *G08B 13/00* (2013.01); *G08B 13/2494* (2013.01); *G08B 25/008* (2013.01); *G08B 25/10* (2013.01); *G08B 21/22* (2013.01)

(58) Field of Classification Search
CPC ..... G08B 13/2494; G08B 25/008
(Continued)

(56) References Cited

U.S. PATENT DOCUMENTS

2010/0015948 A1 1/2010 Nagano
2010/0097214 A1* 4/2010 Sweeney ..... G07C 9/00111 340/545.1
(Continued)

FOREIGN PATENT DOCUMENTS

CN 1801230 A 7/2006
CN 101527072 A 9/2009
(Continued)

OTHER PUBLICATIONS

EPO extended European search report for Application No. / Patent No. 12871094.4 - 1810 / 2826028 PCT/CN2012000321, Oct. 19, 2015.
(Continued)

*Primary Examiner* — Tai Nguyen
(74) *Attorney, Agent, or Firm* — Patents on Demand, P.A.; Brian K. Buchheit; Scott M. Garrett

(57) ABSTRACT

The invention relates to a method for monitoring the security of an area, a corresponding security monitor device and a wireless access device. The method comprises steps of: determining whether there is at least one first mobile device accessing a wireless access device that serves said area; starting to monitor a breach of security conditions, if there is no at least one first mobile device accessing the wireless access device; and, generating an alarm signal and sending said signal to one of said at least one first mobile device, if the breach of security conditions is detected. With this method, it does not need the host to turn on the security monitoring device every time he leaves home and effectively eliminates the possibility of forgetting to turn on the security monitoring procedure by the user, making the security device more reliable and convenient.

15 Claims, 3 Drawing Sheets

(51) Int. Cl.
*G08B 25/00* (2006.01)
*G08B 25/10* (2006.01)
*G08B 21/22* (2006.01)

(58) Field of Classification Search
USPC ..... 340/541, 540, 539.13, 5.7, 545.1; 701/5, 701/30, 31, 39, 206
See application file for complete search history.

(56) References Cited

U.S. PATENT DOCUMENTS

2010/0267399 A1* 10/2010 Sweeney ..... G06Q 10/10 455/456.3
2010/0283579 A1* 11/2010 Kraus ..... G07C 9/00944 340/5.7
2011/0149078 A1 6/2011 Fan et al.

FOREIGN PATENT DOCUMENTS

CN 102355391 A 2/2012
WO WO 2009/111996 A1 9/2009

OTHER PUBLICATIONS

PCT International Search Report for International Application No. PCT/CN2012/000321, Dec. 20, 2012.
PCT Notification Concerning Transmittal of International Preliminary Report on Patentability (Chapter I of the Patent Cooperation Treaty) for International application No. PCT/CN2012/000321, Sep. 16, 2014.

* cited by examiner

HOME SECURITY SYSTEM USING WIRELESS COMMUNICATION

PRIORITY

This nonprovisional application is a U.S. National Stage Filing under 35 U.S.C. §371 of International Patent Application Serial No. PCT/CN2012/000321, filed Mar. 15, 2012 and entitled "A Home Security System Using Wireless Communication."

TECHNICAL FIELD

The invention relates to a system for monitoring security of an area, in particular a home security system with wireless communication.

BACKGROUND

A home anti-theft system is the last and the most important line for residential security. It utilizes automatic security electronic equipments in guarding areas, to identify illegal invasions, alarm and warn at the area, and inform the owners or even the police of the illegal invasions in real time.

A typical anti-theft system with wireless communication is disclosed in US2011/0149078, which comprises a video camera, a force/wave sensor, a microphone, and a wireless communication component. For example, the sensor is used to distinguish between a loud noise such as a siren and the sound of breaking glass, and interprets the broken glass as a type of security breach. Then the anti-theft system may use a wireless session to send an alarm signal to a designated destination, such as by means of a wireless communication SIM card.

Whether it is a GSM Sim-card or any other kind of Sim-card that is used to send the alarm signal, this unit will cost a lot and could be the main cost of the home anti-theft system, especially when real time audio or video contents are included in the alarm signal. The high cost will prevent customers from using such an anti-theft system. In addition, the whole anti-theft system should be started manually by its host. But if the host forgets to start the system sometimes, the whole system will have no use. Therefore there is a need of a more reliable method for monitoring the home security without intervention of its user.

SUMMARY

It is an object of the invention to avoid one or more of the disadvantages mentioned above and to provide an improved method as well as system for monitoring the security of an area.

According to a first aspect of the present invention, there is provided a method for monitoring the security of an area. It is determined first whether there is at least one first mobile device accessing a wireless access point that serves said area. If there is no at least one first mobile device accessing the wireless access device, it starts the security management device to monitor a breach of security conditions automatically.

Preferably, the monitor area is substantially identical with the serve area of the wireless access point. When staying in said area, the first mobile device accesses the wireless access point to get wireless service, such as making a call, transferring data or surfing the internet.

As the mobile device, such as a mobile phone, becomes more and more popular, it has developed into a necessity of our daily life. We take our mobile device with us to everywhere. In the above method according to an embodiment of the invention, the mobile device is considered as a token, and the absence of any mobile device implies that the host has left the home area, therefore the security monitoring procedure will be started automatically when there is no first mobile device accessing the wireless access point. Therefore the method does not need the host to turn on the security monitoring device every time he leaves home and effectively eliminates the possibility of forgetting to turn on the security monitoring procedure by the user, making the solution more reliable and convenient.

According to another embodiment of the invention, the wireless access point receives a signaling from a second mobile device, derives an identifier of said second mobile device from the signaling; compares the identifier of said second mobile device with said at least one identifier of said at least one first mobile device in the security list; and determines that the security conditions have been breached, if the identifier of said second mobile device does not match any one of said at least one identifier of said at least one first mobile device in the security list and said second mobile device has been accessing the wireless access device for a predetermined time period.

By using the wireless access point to identify any strange number that accessed after the monitor system is started, the invention may eliminate the need of any external sensors such as an infrared sensor, heat sensor, et al, and it can detect the breach of security conditions based on a current local wireless communication system. Therefore it reduces cost on external sensors and complicated connection problems in deploying the external sensors and its controller.

According to still another embodiment of the present invention, the wireless access point may store the strange identifier into its access log. Therefore the security method may track down the invader's identifier and its wireless interactions with the access point, for example, the dial out numbers, the dial in numbers et al. It may facilitate the identifying of the invader. Comparing a video recorder that recording the video content of an area for a predetermined time period, for example several hours, days, the present method is very simple and convenient, because it does not need such a dedicated device and mass storage associated.

According to a second aspect of the invention, there is provided a security monitoring device for monitoring the security of an area. The security monitoring device comprises a wireless access point and a security management device. The wireless access point provides wireless access in said area for at least one first mobile device, and generates a first command signal when there is no first mobile device accessing said wireless access point. For example the wireless access point is a Home NodeB device which can provide wireless communication in a limited area. The security management device receives the first command signal from said wireless access point, starts to detect a breach of security conditions in said area.

According to a third aspect of the invention, there is provided a wireless access device, which comprises a transceiver for providing wireless access in its serving area for at lease one first mobile device; and a security management unit for determining whether there is at least one first mobile device accessing a wireless access device that serves said area, and starting to monitor a breach of security conditions, if there is no at least one first mobile device accessing the wireless access device.

The wireless access device may be a wireless access point using 802.11 protocol, or a HNB compliance with GSM, 3G, or LTE communication standards. The wireless access device does not need the host to turn on the security monitoring function every time he leaves home and effectively eliminates the possibility of forgetting turn on the security monitoring procedure by the user, making the present invention more reliable and convenient.

According to another embodiment of the invention, the transceiver receives a signaling from a second mobile device. The security management unit derives an identifier of said second mobile device from said signaling, compares the identifier of said second mobile device with the at least one identifier of said at least one first mobile device in the security list; and determines that the security conditions have been breached if the identifier of said second mobile device does not match any one of said at least one identifier of said at least one first mobile device in the security list. It does not need any external sensors to monitor the security conditions in the serving area of the wireless access point and provide a simple structure for home or office security monitor.

According to a fourth aspect of the invention, there is provided a home security system comprising the above mentioned security monitoring device.

According to a fifth aspect of the invention, there is provided a computer program product comprising computer-readable medium. The computer-readable medium comprises code for determining whether there is at least one first mobile device accessing a wireless access device that serves said area. The computer-readable medium further comprises code for starting the security management device to detect a breach of security conditions, if there is no at least one first mobile device accessing the wireless access device. The computer-readable medium further comprises code for generating an alarm signal and sending said signal to one of said at least one first mobile device, if the breach of security conditions is detected.

Other objects and features of the present invention will become apparent from the following detailed descriptions considered in conjunction with the accompanying drawings. It is to be understood, however, that the drawings are designed solely for the purposes of illustration and not as a definition of the limits of the invention.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION OF THE EMBODIMENTS

With the development of the mobile phone networks, a new class of small base stations has emerged, which may be installed in a user's home and provide indoor wireless coverage to mobile units using existing broadband Internet connections. Such personal miniature base stations are generally known as access point base stations, or, alternatively, Home NodeB (HNB) or femto nodes. According to statistics, about half of the phone calls are made from inside building and lots of users complain the poor signal and QoS in the building. HNB's appearance solves this problem and can offer excellent mobile phone coverage and data speeds at home, in the office and public areas for both voice and data communication. A cell associated with a macro node, a femto node, or a pico node may be referred to as a macro cell, a femto cell, or a pico cell, respectively.

Figure 1:
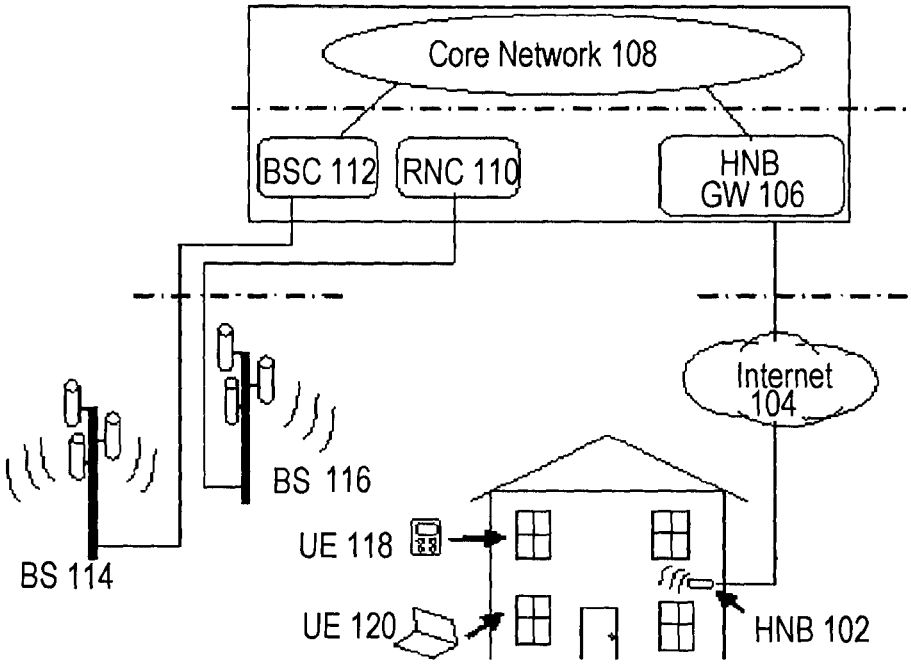
FIG. 1 illustrates a diagram of a typical communication network with an Home NodeB, in which embodiments according to the present invention may be implemented.

FIG. 1 illustrates a diagram of a typical communication network with an Home NodeB, in which embodiments according to the present invention may be implemented. The HNB is illustrated as 102 in the house and it can provide wireless communication to the User Equipment (UE), such as UE 118 and UE 120 in the house area. In various applications, other terminology may be used to reference a macro node, a femto node, or a pico node. For example, an HNB node may be configured or referred to as a Home eNodeB, femto node, access point base station, femto cell, and so on. The UE 118, 120 may be a wireless communication device (e.g., a mobile phone, router, personal computer, server, etc.) used by a user to send and receive voice or data over a communications network. A user equipment (UE) may also be referred to herein as an access terminal (AT), as a mobile station (MS), or as a terminal device.

The HNB 102 may communicate with the Internet 104 via a wired link or via a wireless link. The UE 118, 120 may communicate with the HNB 102 via a wireless link. No additional software or update is required to enable the UE 118 to work with the HNB 102. When a call from the mobile phone 118 is made, the signals are sent in an encrypted form from the HNB 102 via the public or private broadband IP network 104 to an HNB gateway 106 of the mobile operator, and therefore to the Core Network 108. The HNB GW 106 serves the purpose of a RNC presenting itself to the Core Network 108 as a concentrator of HNB connections, as well as providing service to the HNB 102.

When in the range of the HNB 102, the mobile phone 118 will automatically detect the HNB 102 and use it in preference to the outdoor cellsites, such as BS 114 or 116. Restrictions can be applied on who can access the HNB 102. In a restricted access mode, HNBs are restricted service to a access list of up to 30 specified identifiers. For example, the host of the HNB may assign its host number(s) and guest number(s) into the access list. In addition to the telephone numbers of a UE, the UE can also be identified by the following unique identifiers: ESN, IMEI (International Mobile Equipment Identity), IMSI, LAI (Location Area Identification), TMSI(Temporary Mobile Subscriber Identity), P-TMSI (Packet Temporary Mobile Subscriber Identity), RAI (Routing Area Identification), ESN(DS-41), IMSI (DS-41), and TMSI(DS-41).

The HNB also has an open mode wherein it is open to all, including visitor numbers that are unknown to the HNB. The HNB 102 may switch between the restricted access and open access as desired. The cell range of HNB is quite small, about 20 m to 50 m and the common HNB usually support 16 users registering and 4 calls at the same time. The HNB can also be tied to a telephone number and send message to the host automatically when nobody is available at home to answer the phone. The inventor realized that the serving area of the HNB is associated to the area of a private home area, which is identical with the monitoring area of an home security area, and brought up with a novel concept of using the current functions of the HNB to meet lots of requirements in the home security system such as a home anti-theft system, as described in detail below.

Figure 2:
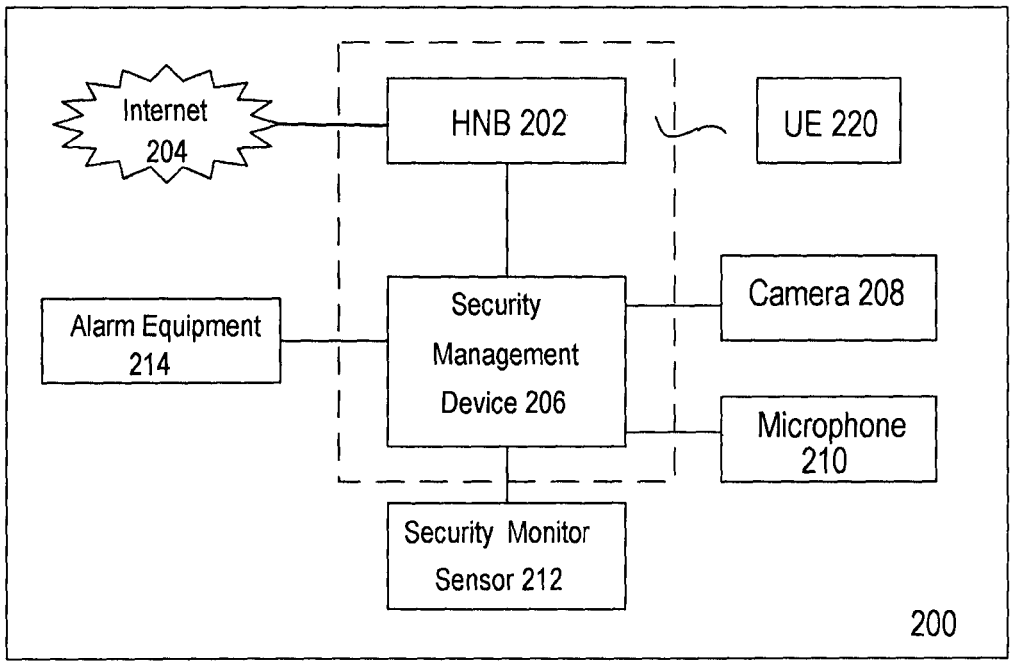
FIG. 2 schematically illustrates blocks of the structure of a security monitoring device according to an embodiment of the invention.

FIG. 2 schematically illustrates blocks of the structure of a security monitoring device according to an embodiment of the invention. The home security monitor device 200 is based on a HNB 202. The HNB 202 may provide conventional functions such as wireless communications for a UE 220, which is preferably a mobile phone, in the area. The serving area of the HNB 202 is substantially identical with the monitoring area of the security monitor device 200. The mobile phone 220 may get its voice or digital service by accessing the HNB 202. The HNB 202 then links to the Core Network through an interne 204, as we discussed above. The HNB 202 may be external to the home security monitor device 200 and connect to the home security device 200 by wireless or wired connections.

The home security monitor device 200 further comprises a security management device 206 for controlling functions and components of the home security monitor device 200. The HNB 202 and the security management device 206 may be separate from each other and connected via wired or wireless connections. According to an embodiment of the present invention, they can also be integrated into one piece.

The security monitor device 200 may operate in two modes: a standby mode and a monitor mode. Preferably the security monitor device 200 operates in the standby mode when the host is at home, so as to save power and avoid possible false alarms. In this mode, only the HNB 202 is active to provide voice and digital communications as a conventional HNB as well as detect the presence of the host. When the host leaves home, the security monitor device 200 may be switched to monitor mode to monitor the security conditions of the area.

According to one embodiment of the present invention, the telephone number of the host and optionally the telephone numbers of some guests that the host trust are pre-stored in an access list in the HNB 202. When the HNB 202 detects that there is no host number accessing, it sends a start command to the security management device to switch the whole home security monitor device 200 from the standby mode to the monitor mode. Then the home security monitor device 200 will monitor the security conditions of the area. After the host number re-accesses the HNB 202 later, the HNB 202 will send an end command to the security management device 206 to switch the security monitor device 200 back to the standby mode. In this way, the user would not need to manually switch the mode of the home security monitor device 200.

Optionally the home security monitor device may have a security sensor 212 for detecting the breaking in of any invader when the security monitor device 200 operates in the monitor mode. The security sensor 212 may be a motion detector positioned on a door or window, an accelerometer, an acoustic sensor, or a temperature sensor or the like, which sensors are well know to the skilled person in the art. With the security sensor 212, the home security monitor device 200 may detect a breach of the security conditions of the area, for example, broken of the window glass, or broken of the door. After a invasion information is detected by the security sensor 212, it may inform the security management device 206. The security management device 206 will perform a variety of operations accordingly, for example, generating an alarm siren in the area, and/or sending an alarm signal to the host number and/or dialing a specific number of a security authority such as a police station. Preferably the alarm signal may comprise the real time video or audio information of the area.

According to another embodiment of the present invention, in addition to or instead of the security sensor 212, the HNB 202 may serve to detect the breach of security conditions, as we will explained below. After the host number is logged out from the HNB 202, the HNB 202 continues to provide wireless service and detect any newly accessing numbers when the home security monitor device 200 operates in the monitor mode. The HNB 202 will compare the newly accessing numbers with the host number and guest numbers stored in the access list. If the newly accessing number is the host number, the HNB 202 will send an end signal to switch the home security monitor device into standby mode. If the newly accessing number is a guest number, it will store the guest number into an access log, together with the access information of said guest number, for example, the start and end of the access time. If said newly accessing number is a strange number, i.e. it is not a host number or guest number, then the HNB 202 determines that there is a stranger in the area and therefore send a message to the security management device 206 to inform the breach of the security conditions. Then the security management device 206 will generate the alarm siren in the area, and/or send an alarm signal, as we mentioned above.

According to another embodiment of the present invention, the operation modes of the home security monitor device 200 are associated with corresponding accessing mode of the HNB 202. When the home security monitor device 200 is working in the standby mode, the HNB 202 will operate in a restricted access mode, and the accessing to the HNB 202 is limited to the host number and the guest number that is preset. When the HNB 202 detects the absence of any host number, it will automatically switch to an open access mode to permit the access of a stranger number while the home security monitor device 200 is working in its monitor mode.

To capture the video or audio information, the home security monitor device 200 further comprises a camera 208 for capturing video or image content of the area. For example the camera 208 may be positioned above the stairs in the house, towards a door or a windows, or in some place to capture the real-time content of some articles, for example a safe or an art object. The home security monitor device 200 further comprises a microphone 210 for capturing audio information in the area. In an embodiment, the microphone 210 may be integrated into the camera 208 to provide both audio and video information at the same time. The camera 208 and the microphone 210 may be connected to the security management device 206 via wired or wireless communications.

The home security monitor device 200 also has an alarm equipment 214 to generate alarm siren in the field to frighten the illegal intruders or notice the security person nearby. Although the above embodiments are described in the context that the serving area of the HNB is identical with the monitoring area of the home security monitor device 200, the monitoring area may also be comprised of several serving areas of several HNBs, and these the security management device 206 are used to coordinate theses different HNBs to detect the presence of a host mobile phone or a strange mobile phone as described above.

Figure 3:
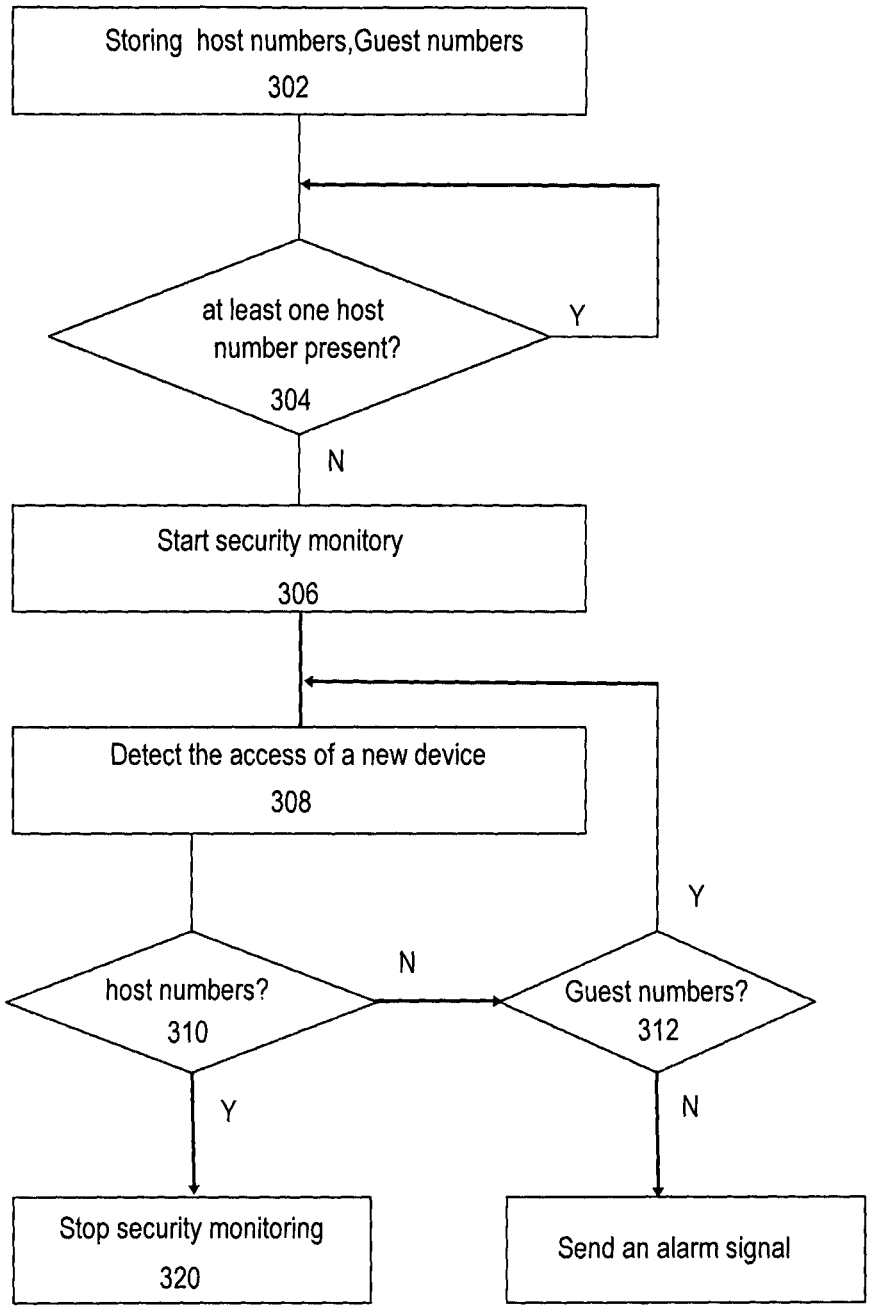
FIG. 3 shows a flow chart of a security monitoring method according to an exemplary embodiment of the invention.

FIG. 3 shows a flow chart of a security monitoring method according to an exemplary embodiment of the invention. At step 302, the host may store host numbers of his mobile phone into the access list of the HNB 202. Preferably he may also store the guest numbers of the person he trusts into the access list. The access list may be stored in a nonvolatile memory or storage device (e.g., Flash memory, read only memory (ROM), magnetic disk, optical disc, remote device or storage accessed over a network, and so forth), that is accessible to the HNB 202. Alternatively the mobile phones of the host or his guests can be identified by some unique identifiers of the mobile phone, for example, its IMEI or IMSI.

After the host numbers are pre-stored in the security list, the HNB 202 may monitor the access status of the host mobile phone through any one of the above mentioned identifiers, and determines whether there is at least one host mobile device accessing the HNB, step 304.

If the HNB 202 determines that there is no host mobile phone using its service, then the HNB 202 send a start command to the security management device 206 to switch the security monitor device 200 from a standby mode to a monitor mode. Thus the security management device starts to detect a breach of security conditions for example the invasion of a stranger, step 306.

The HNB 202 continues to provide wireless service in the area and detect any newly accessing mobile phones in the following step 308. The HNB 202 may derive the identifier of the newly accessing mobile phones from the signaling between the new mobile phone and the HNB 202 with conventional methods. The identifier of a mobile phone can be any unique identifier that can distinguish one mobile phone from another one, for example, it may be the telephone, number of the SIM card, the IMEI or IMSI of the mobile phone, et al.

Then the HNB 202 would compares the identifier of the newly accessing mobile phone with the ones stored in the security list to determine whether it is a host number in step 310. If it is the host number that are reentering the area, then the HNB 202 may send an end command to the security management device 206 to switch it back to the standby mode. And the security monitor procedure end in step 320.

However if it is determined that the newly accessing number is not the host number, the HNB 202 will further compare the identifier of the newly accessing mobile phone with the guest numbers in the access list in step 312.

If the newly accessing number is a guest number, the procedure will go back to step 308 to continue detect further newly accessing number. In addition, the HNB 202 may also record the access status of the guest number into its access log, together with the access information of said guest number, for example, the start and end of the access time.

If the newly accessing number is not a guest number, it may determined that the newly access number comes from a stranger and the area has been broken in, then the HNB 202 send a message to the security management device 206 to inform the breach of the security conditions, step 314. Then the security management device 206 will generate the alarm siren in the area, and/or send an alarm signal, as we mentioned above. The alarm signal may comprise real-time video information captured by a camera or real-time audio information captured by a microphone. Preferable the identifier of stranger number is also stored in the access log.

According to one embodiment of the invention, to avoid false alarm that is caused by a stranger that is passing by, the HNB may set a threshold of the accessing time period of the stranger number. If the access time of the stranger number exceeds the threshold, for example, 5-30 minutes, then the HNB 202 will determine that there is an actual danger of illegal invasion. Otherwise, the HNB 202 will consider said stranger number as a belonging to a passenger and ignore it.

According to another embodiment of the invention, during the monitor mode, the security management device 206 may use some external sensors to detect any illegal invasions. In this case, after an invasion is detected by the security sensor, it may inform the security management device 206 to perform all kinds of alarm operations as mentioned above.

Figure 4:
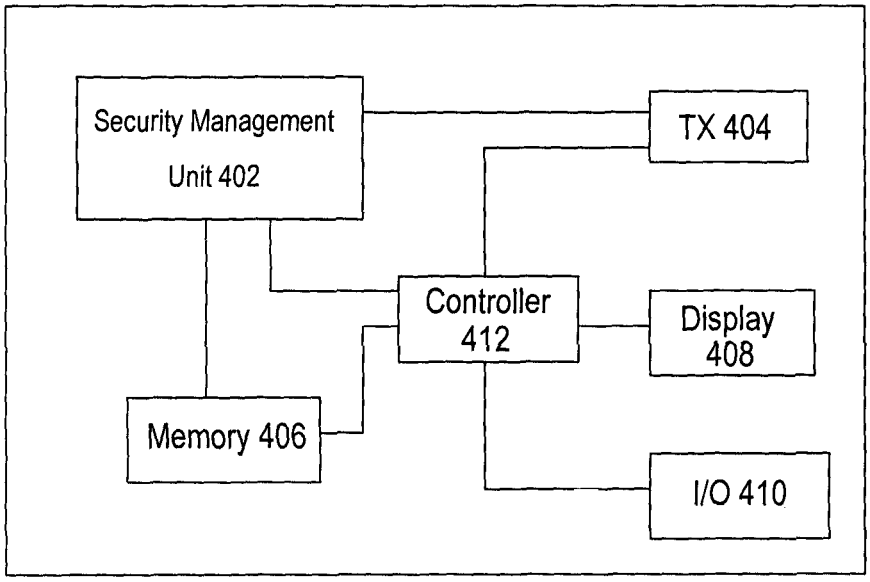
FIG. 4 schematically illustrates blocks of the structure of a HNB which can be used to monitor security of an area according to one embodiment of the invention.

In addition, in the above embodiments the HNB 202 is incorporated into the home security monitor device 200 as a component of the monitor device. However it may work as a separate device and be provided with the additional security monitor function as described in FIG. 4. FIG. 4 schematically illustrates blocks of the structure of a HNB which can be used to monitor security of an area according to one embodiment of the invention.

The HNB 400 comprises a security management unit 402, a transceiver 404, a memory 406, a display 408, a I/O interface 410 and a controller 412. Except for the security management unit 402, all the components of the HNB 400 may work as those in a typical HNB. The controller 412 is used to control these different components to function as a normal home base station. The transceiver 404 may provide bidirectional communications in the serving area of the HNB 400 for a mobile device. The communications may be in a format compliance with such as Code Division Multiple Access (CDMA) networks, Time Division Multiple Access (TDMA) networks, Frequency Division Multiple Access (FDMA) networks, Orthogonal FDMA (OFDMA) networks, Single-Carrier FDMA (SC-FDMA) networks, etc. The display 408 is used to display operation information to the user so as to allow a more intuitive manipulation of the HNB. The I/O interface 410 is used to connect the HNB with some external devices, for example the Internet 104 as we discussed above. The HNB can also be connected to a security sensor which may detect the presence of any invader, a camera which captures video or image content, or a microphone for collecting audio information. The memory 406 is used to store program code or data necessary for the operations of the HNB. In addition, the memory 406 also stores the telephone number of the host and optionally the telephone numbers of some guests that the host trust in an access list. The host may edit the access list as desired.

The security management unit 402 may determine the security status of the area together with the other components of the HNB. When the security management unit 402 determines that there is no host number accessing, it starts to monitor the security status of the area, i.e. to detect the presence of any illegal invasion.

After the host number is logged out from the HNB, the transceiver 404 continues to provide wireless service and detect any newly accessing numbers. The security management unit 402 compares the newly accessing numbers with the host number and guest numbers stored in the access list. If the newly accessing number is the host number, the security management unit 402 will stop security monitoring and switch the HNB back to normal operation.

If the newly accessing number is a guest number, it will store the guest number into an access log, together with the access information of said guest number, for example, the start and end of the access time. If said newly accessing number is a strange number, i.e. it is neither a host number nor a guest number, the security management unit 402 determines that there is a stranger in the area. The security management unit 402 may set a threshold of the accessing time period of the stranger number. If the duration of the stranger number's access time exceeds the threshold, for example, 2-10 minutes, then the security management unit 402 determines that there is an actual danger of illegal invasion. Otherwise, it will consider said stranger number as a belonging to a passenger and ignore it. After the actual danger has been determined, the security management unit 402 will generate an alarm siren in the area, and/or send an alarm signal, as we mentioned above.

Any of the methods described herein can be performed by computer-executable instructions stored on one or more non-transitory computer-readable media (e.g., storage or other tangible media).

Although various aspects of the invention are set out in the accompanying independent claims, other aspects of the invention may include any combination of features from the described embodiments and/or variants and/or the accompanying dependent claims with the features of the independent claims, and not solely the combinations explicitly set out in the accompanying claims.

Furthermore, the terms first, second and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein. For example, instead of using one access list, the host numbers and the guest numbers maybe stored in two separate list, an access list and a guest list, respectively. These two lists may be used in dependence on different security levels. For example in a high security level even the presence of a guest number will be deemed as the breach of security conditions, whereas in a lower level, said guest number will be deemed as not harmful to the security. The other parameters, such as the threshold for determining whether there is an actual danger, can also be set in dependence on different security levels. In a high security level, this threshold may be set to a very small time interval, for example, 1 minutes, or several seconds. But in a low security level, said threshold may take a bigger value such as serveral minutes to half an hour.

It should be noted that the above-mentioned embodiments illustrate rather than limiting the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A method for monitoring security of an area, comprising:

determining whether there is at least one first mobile device accessing a wireless access device that serves said area;

starting to monitor a breach of security conditions, if there is no said at least one first mobile device accessing the wireless access device; and generating an alarm signal and sending said alarm signal to one of said at least one first mobile device, if the breach of security conditions is detected, wherein the breach of security conditions is monitored by:

receiving a signaling from a second mobile device; deriving an identifier of said second mobile device from said signaling; comparing the identifier of said second mobile device with the at least one identifier of said at least one first mobile device in a security list; and determining that the security conditions have been breached if the identifier of said second mobile device does not match any one of said at least one identifier of said at least one first mobile device in the security list.

2. The security monitoring method according to claim 1, wherein said at least one first mobile device is a host device, and at least one identifier of said at least one first mobile device is stored in the security list.

3. The security monitoring method according to claim 2, wherein the breach of security conditions is monitored by:

receiving a signaling from a second mobile device;

deriving an identifier of said second mobile device from said signaling;

comparing the identifier of said second mobile device with said at least one identifier of said at least one first mobile device in the security list; and determining that the security conditions have been breached, if the identifier of said second mobile device does not match any one of said at least one identifier of said at least one first mobile device in the security list and said second mobile device has been accessing the wireless access device for a predetermined time period.

4. The security monitoring method according to claim 1, wherein the identifier of said second mobile device is stored in an access log.

5. The security monitoring method according to claim 1, wherein said at least one identifier of said at least one first mobile device and the identifier of said second mobile device are selected from a group consisting of: ESN, IMEI, IMSL, LAI, P-TMSI, RAI, TMSI, ESN(DS-41), IMSI(DS-41), and TMSI(DS-41).

6. The security monitoring method according to claim 1, wherein the breach of security conditions is monitored by at least one of an infrared sensor, an acoustic sensor, a temperature sensor or an motion sensor, which is used to detect abnormal condition in the area.

7. A security monitoring device for monitoring security of an area, comprising:

a wireless access device including a transceiver for providing wireless access in said area for at least one first mobile device, and generating a first command signal when there is no said at least one first mobile device accessing said wireless access device; and a security management device, for receiving the first command signal from said wireless access device, starting to monitor a breach of security conditions in said area, and generating an alarm signal and sending said alarm signal to one of said at least one first mobile device, if the breach of security conditions is detected, wherein the transceiver is further configured to receive a signaling from a second mobile device; and the security management unit is further configured to derive an identifier of said second mobile device from said signaling;

compare the identifier of said second mobile device with the at least one identifier of said at least one first mobile device in a security list; and determine that the security conditions have been breached if the identifier of said second mobile device does not match any one of said at least one identifier of said at least one first mobile device in the security list.

8. A wireless access device, comprising:

a transceiver for providing wireless access in its serving area for at least one first mobile device;

a security management unit for determining whether there is at least one first mobile device accessing a wireless access device that serves said area, and starting to monitor a breach of security conditions, if there is no said at least one first mobile device accessing the wireless access device, wherein the transceiver is further configured to receive a signaling from a second mobile device; and the security management unit is further configured to derive an identifier of said second mobile device from said signaling;

compare the identifier of said second mobile device with the at least one identifier of said at least one first mobile device in a security list; and determine that the security conditions have been breached if the identifier of said second mobile device does not match any one of said at least one identifier of said at least one first mobile device in the security list.

9. The wireless access device according to claim 8, further comprising a memory for storing at least one identifier of said at least one first mobile device in the security list, and wherein said at least one first mobile device is a host device.

10. The wireless access device according to claim 9, wherein the transceiver is further configured to receive a signaling from a second mobile device; and the security management unit is further configured to derive an identifier of said second mobile device from said signaling;

compare the identifier of said second mobile device with said at least one identifier of said at least one first mobile device in the security list; and determine that the security conditions have been breached, if the identifier of said second mobile device does not match any one of said at least one identifier of said at least one first mobile device in the security list and said second mobile device has been accessing the wireless access device for a predetermined time period.

11. The wireless access device according to claim 8, wherein the memory is further configured to store the identifier of said second mobile device in an access log.

12. The wireless access device according to claim 8, wherein said at least one identifier of said at least one first mobile device and the identifier of said second mobile device are selected from a group consisting of: ESN, IMEI, IMSI, LAI, P-TMSI, RAI, TMSI, ESN(DS-41), IMSI(DS-41), and TMSI(DS-41).

13. The wireless access device according to claim 8, wherein the wireless access device is a Home Node B device.

14. A home security system comprising a wireless access device according to claim 8.

15. A computer program product comprising a non-transitory computer-readable medium, which comprises:

code, stored in the non-transitory computer-readable medium and executable by a processor, for determining whether there is at least one first mobile device accessing a wireless access device that serves said area;

code, stored in the non-transitory computer-readable medium and executable by a processor, for starting to detect a breach of security conditions, if there is no said at least one first mobile device accessing the wireless access device; and code, stored in the non-transitory computer-readable medium and executable by a processor, for generating an alarm signal and sending said alarm signal to one of said at least one first mobile device, if the breach of security conditions is detected, wherein the breach of security conditions is monitored by code, stored in the non-transitory computer-readable medium and executable by a processor, for:

receiving a signaling from a second mobile device;

deriving an identifier of said second mobile device from said signaling;

comparing the identifier of said second mobile device with the at least one identifier of said at least one first mobile device in a security list; and determining that the security conditions have been breached if the identifier of said second mobile device does not match any one of said at least one identifier of said at least one first mobile device in the security list.

* * * * *